US006343536B1

(12) United States Patent
Rossier et al.

(10) Patent No.: US 6,343,536 B1
(45) Date of Patent: Feb. 5, 2002

(54) AUTOMATED PROJECTILE FIRING WEAPON AND RELATED METHOD

(75) Inventors: Glenn E. Rossier, Ferrisburg; Larry W. Hayes, South Burlington; David L. Steimke, Burlington; Victor Forrester, Williston, all of VT (US)

(73) Assignee: General Dynamics Armament Systems, Burlington, VT (US)

( * ) Notice: Subject to any disclaimer, the term of this patent is extended or adjusted under 35 U.S.C. 154(b) by 0 days.

(21) Appl. No.: 09/441,195

(22) Filed: Nov. 16, 1999

(51) Int. Cl.[7] ..... F41A 19/02

(52) U.S. Cl. ..... 89/161; 89/162; 89/177; 89/178; 89/129.01

(58) Field of Search ..... 89/161, 162, 177, 89/178, 129.01, 9; 42/1.06

(56) References Cited

U.S. PATENT DOCUMENTS

| | | | | | |
|---|---|---|---|---|---|
| 2,212,687 | A | | 8/1940 | Hughes | 89/162 |
| 3,969,982 | A | | 7/1976 | Pier-Amory et al. | 89/162 |
| 4,024,792 | A | | 5/1977 | Möller | 89/162 |
| 4,072,082 | A | | 2/1978 | Bates et al. | 89/162 |
| 4,391,180 | A | | 7/1983 | Koine | 89/162 |
| 5,014,595 | A | * | 5/1991 | Ducolon, Jr. | 89/178 |
| 5,123,329 | A | * | 6/1992 | Irwin | 89/161 |
| 5,138,931 | A | * | 8/1992 | Brookshire | 89/161 |
| 5,585,590 | A | * | 12/1996 | Ducolon | 89/162 |

OTHER PUBLICATIONS

SacoDefense, Incorporated, Striker 40mm, Advanced Lightweight Grenade Launcher (ALGL), Product Description. Recoilless Trap, Product Description and Specifications.

* cited by examiner

*Primary Examiner*—J. Woodrow Eldred
(74) *Attorney, Agent, or Firm*—Finnegan, Henderson, Farabow, Garrett & Dunner L.L.P.

(57) ABSTRACT

An automatic projectile firing weapon and a related method for absorbing the recoil force of an automatic projectile firing weapon are disclosed. The weapon includes a barrel assembly that is slidably mounted in a receiver, biased by an operating spring, and engageable with a main sear. A gas operated bolt assembly is slidably mounted within the barrel assembly and is driven by a bolt spring. A trigger is provided to release the main sear and allow the operating spring to move the barrel assembly forwardly in the receiver. There is further provided a buffer connected between the receiver and the barrel assembly to dampen the velocity of the barrel assembly to ensure the barrel assembly is moving at a predetermined maximum velocity when a round is fired at a predetermined firing position. The recoil energy from the fired round is absorbed mainly by the forward motion of the barrel assembly and in part by the operating spring and buffer. In this manner, the peak recoil load to the receiver is minimized and the weapon operates at its actual firing rate from the first shot.

26 Claims, 17 Drawing Sheets

AUTOMATED PROJECTILE FIRING WEAPON AND RELATED METHOD

BACKGROUND OF THE INVENTION

The present invention relates generally to automatic projectile firing weapons. More particularly, the invention relates to a method and apparatus for absorbing the recoil force of an automatic projectile firing weapon.

In many combat situations, a lightweight, easily portable automatic weapon that is capable of accurately firing a projectile over a significant distance would provide a decisive tactical advantage. There are many existing small and medium caliber automatic weapons that are specifically designed to fill particular combat needs. However, weapons that are effective at ranges of up to 2,000 meters, for example the 0.50 caliber M2 heavy machine gun and the 40 mm Mk-19 grenade, are too bulky and heavy to be easily portable. Other automatic weapons, like the 7.62mm M60/M240 medium machine guns and the 5.56 mm M249 squad automatic weapon, are easily portable but are not effective at long ranges.

The accuracy of a weapon at a long range is dependent upon the ability of the weapon to manage the recoil force of the fired projectile. The magnitude of the recoil force is a function of the mass and velocity of the projectile which directly effects the expected travel distance (range) of the fired projectile. As the expected range of the weapon increases, so does the magnitude of the recoil force. Weapons designed to fire projectiles over a significant distance typically have a greater weight than weapons designed to fire projectiles over a shorter range. The greater weight is necessary to restrain the more energetic cartridges, absorb the increased recoil force, and prevent the recoil force from disrupting the accuracy of the weapon.

To reduce the weight of a weapon that is accurate over a significant range, an improved method of handling the recoil force must be found. Many attempts have been made to manage the recoil force beyond the typical short recoil cycle or gas operated bolt cycle. In some designs, a counterweight is attached to the recoiling mass of the weapon to absorb the recoil energy. In other designs, a spring is used to absorb and store the recoil force. The energy stored in the spring or counterweight can then be used to move the recoiling mass forward when the next projectile is fired. The forward momentum of the counter-recoiling mass will partially absorb the recoil force of the next projectile.

However, these designs fail to account for the recoil force resulting from the first projectile. Because the first projectile is fired when the weapon is in a resting state, the only resistance to the initial recoil force is the spring or counterweight. This results in a higher load on the recoil system when the first projectile is fired as compared to subsequent shots. In a tripod mounted weapon, this higher load lifts the front leg of the tripod higher off the ground, which will disrupt the accuracy of at least the first few projectiles of a burst. The higher load also causes instability in the gun/mount system, which may only be corrected by increasing the amount of ballast in the system.

After a transient period, the weapon and mount will overcome the recoil overload and achieve a steady state dynamic recoil action. If the weapon is flexibly mounted, it is likely the weapon will not become accurate and effective until the transient period is passed and the weapon enters this steady state recoil action. However, during the transient period, several projectiles are wasted before the weapon settles into the steady state recoil action. Furthermore, due to mount flexibility, a steady state recoil action can have significant effects on accuracy.

In light of the foregoing there is a need for an automatic weapon that minimizes the effect of the recoil force of both the initially fired rounds and all subsequent rounds.

SUMMARY OF THE INVENTION

Accordingly, the present invention is directed to an automatic projectile firing weapon that obviates one or more of the limitations and disadvantages of prior art automatic projectile firing weapons. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to an automatic projectile firing weapon. The weapon includes a receiver that has a main sear and a trackway. A barrel assembly is slidably mounted in the trackway and is moveable between a rearward position and a forward position. The barrel assembly is engageable with the main sear at the rearward position. A firing position is located between the rearward position and the forward position and preferably closer to the forward position. There is provided an operating spring connected between the receiver and the barrel assembly. The operating spring biases the barrel assembly towards the forward position. There is also provided a manual retracting device that moves the barrel assembly rearwardly into engagement with the main sear, thereby compressing the operating spring. A trigger is provided to release the main sear and allow the operating spring to move the barrel assembly forwardly along the trackway of the receiver. There is further provided a buffer connected between the receiver and the barrel assembly to dampen the velocity of the barrel assembly to prevent the barrel assembly from exceeding a predetermined maximum velocity when a round is fired. The recoil energy from the fired round is absorbed in part by the forward motion of the barrel assembly and in part by the operating spring. The recoil force felt by the receiver is that of the operating spring and, in part, the buffer.

In another aspect, the invention is directed to a method of absorbing the recoil force of a projectile firing weapon. The weapon includes a barrel assembly slidably mounted in a receiver and an operating spring connected between the receiver and the barrel assembly. The method involves compressing the operating spring by retracting the barrel assembly within the receiver to engage the barrel assembly with a main sear when the operating spring is fully compressed. The main sear is released to allow the operating spring to bias the barrel assembly forwardly within the receiver. A round is chambered as the barrel assembly moves forwardly along the trackways. The forward motion of the barrel assembly is buffered to prevent the barrel assembly from exceeding a predetermined maximum velocity. The round is fired when the barrel assembly reaches a predetermined location in the receiver. The recoil force of the fired shot reverses the motion of the barrel assembly to move the barrel assembly rearward and re-compress the operating spring. The buffer is configured to maintain a nearly constant dynamic condition of the barrel assembly during the firing and recoil portions of the operating cycle so that effects of varying friction, weapon attitude, and cartridge impulse on the weapon operating cycle are minimized.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DETAILED DESCRIPTION

Reference will now be made in detail to a preferred embodiment of the invention, an example of which is illustrated in the accompanying drawings. Wherever possible, the same reference numbers will be used throughout the drawings to refer to the same or like parts.

In accordance with the present invention, an automatic projectile firing weapon is provided. The exemplary embodiment of the weapon of the present invention is a lightweight automatic crew served weapon for firing medium caliber munitions. The present invention contemplates, however, that the principles and methods disclosed herein are applicable to automatic weapons of all sizes. The exemplary embodiment of the automatic projectile firing weapon of the present invention is shown in FIG. 1 and is designated generally by the reference number 20.

Figure 1:
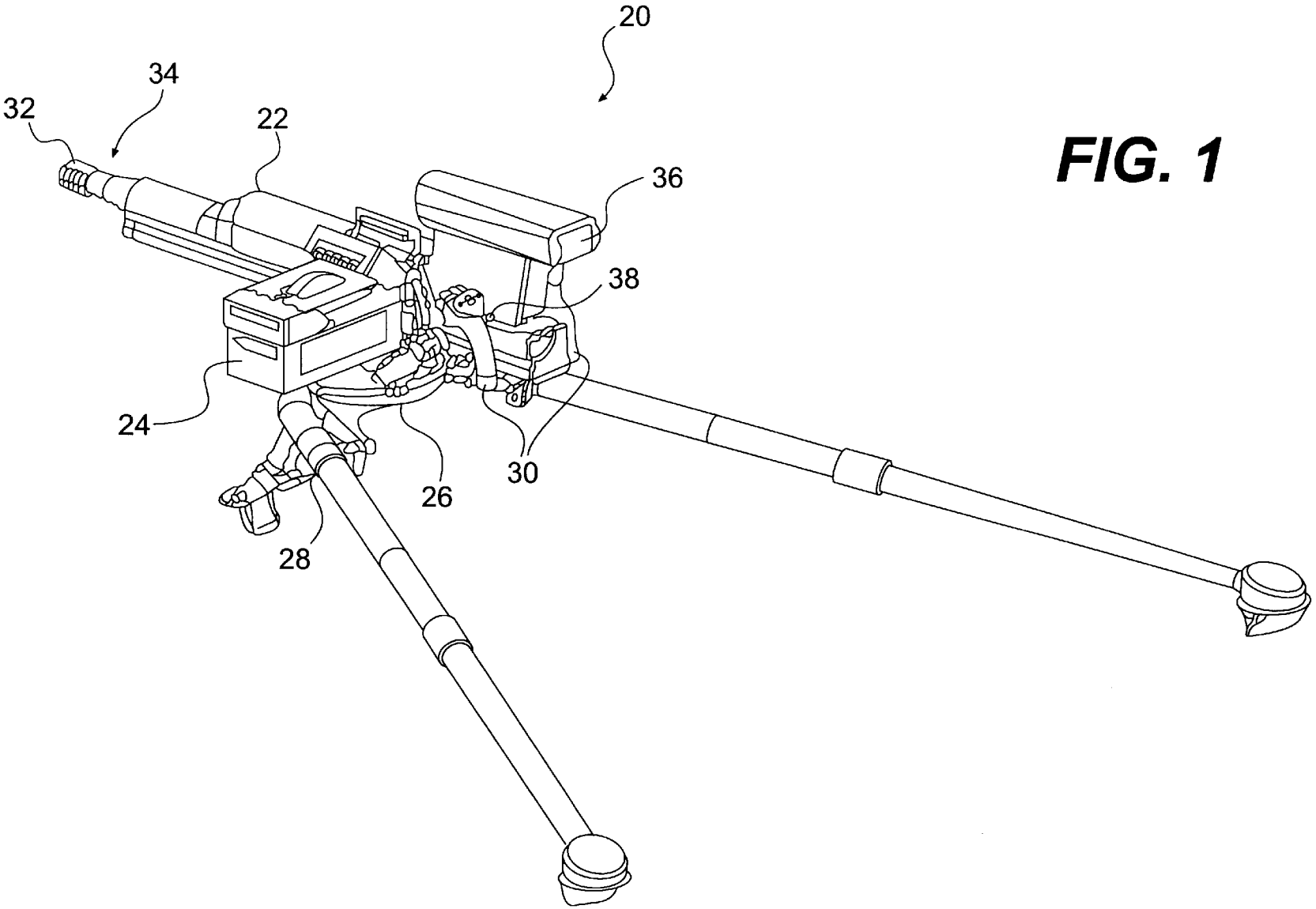
FIG. 1 is a perspective view of an automatic projectile firing weapon according to the present invention.

As illustrated in FIG. 1, weapon 20 includes a receiver 22, a mount 26, and a pair of handles 30 that are attached to receiver 22. Mount 26 allows weapon 20 to be pivoted horizontally (traverse) and vertically (elevation) to provide a full range of firing directions. Handles 30 can be manipulated to horizontally or vertically pivot the weapon about mount 26 to adjust the aim of weapon 20.

Mount 26 connects receiver 22 to a flexible structure. In the exemplary embodiment, weapon 20 is mounted on a tripod 28. The present invention contemplates, however, that weapon 20 may be mounted on any other flexible structure readily apparent to one skilled in the art, such as, for example, a moving vehicle.

Figure 2:
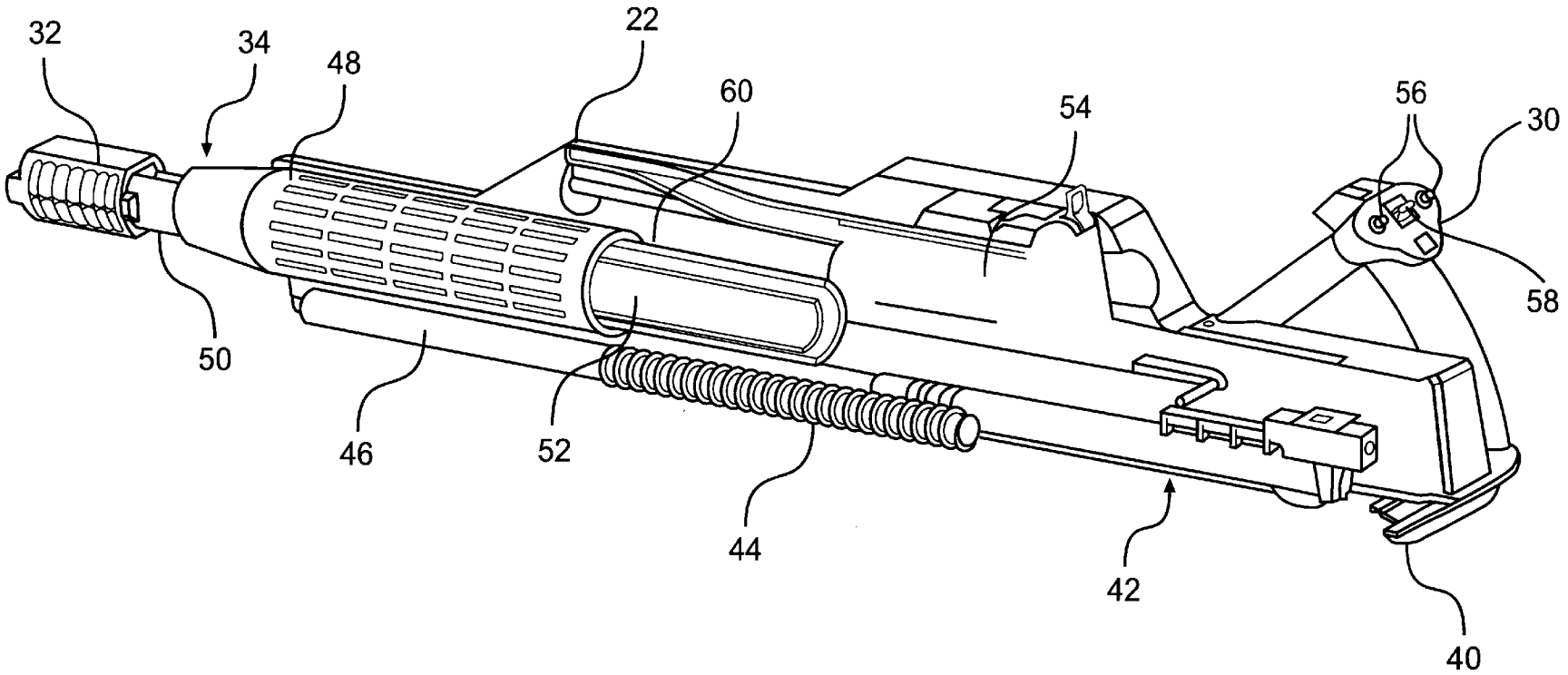
FIG. 2 is a partial perspective cut-away view of the automatic projectile firing weapon of the present invention.

Preferably, the weapon 20 also includes a targeting device 36. Targeting device 36 may include direct view optics and a laser targeting system or any other range finding instrument readily apparent to one skilled in the art. In addition, targeting device 36 may also include a display screen to display information from the laser targeting system or other information regarding firing status of the weapon. As illustrated in FIG. 2, each of the pair of handles 30 may include a set of buttons 56. Buttons 56 may be used to activate the laser targeting system or perform any standard operating function of targeting device 36.

In accordance with the present invention, the weapon includes a barrel assembly that is slidably mounted within the receiver. The barrel assembly is moveable between a rearward position and a forward position and has a firing position between the rearward and forward positions. An operating spring is connected between the receiver and the barrel assembly. The operating spring biases the barrel assembly forwardly within the receiver. In the disclosed embodiment, the barrel assembly is slidably mounted on a trackway in the receiver. The present invention contemplates that other types of mountings will be readily apparent to one skilled in the art.

As embodied herein and illustrated in FIG. 1, weapon 20 includes a receiver 22. A barrel assembly 34 is contained within the receiver 22. As illustrated in FIG. 2, an operating spring 44 is disposed on a guide 46. Operating spring 44 is connected between receiver 22 and barrel assembly 34 so that a rearward movement of barrel assembly 34 operates to compress operating spring 44. A buffer (not shown) is also connected between the barrel assembly 34 and the receiver 22.

Figure 3:
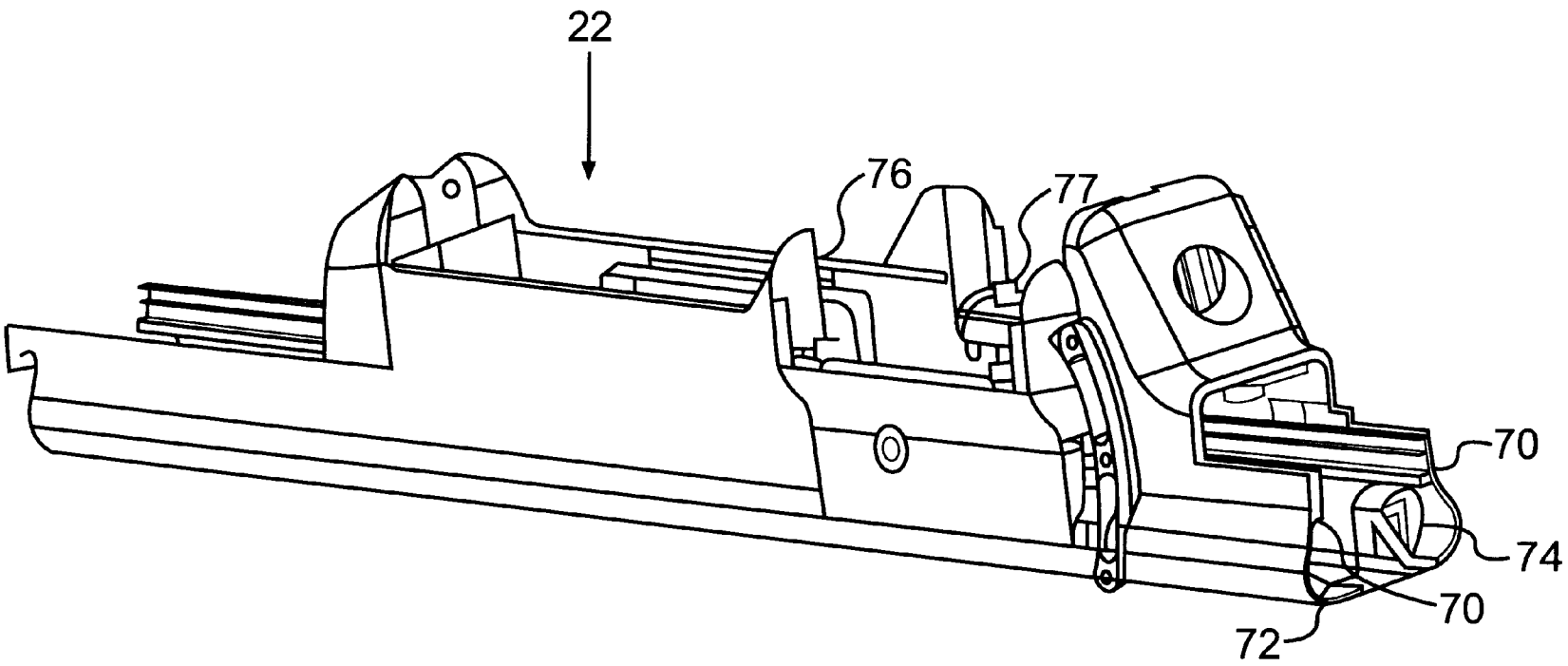
FIG. 3 is a perspective view of a receiver according to the present invention.

As illustrated in FIG. 3, receiver 22 includes an operating spring compartment 72, a buffer compartment 74, and tracks 70. Operating spring 44 and guide 46 are positioned within operating spring compartment 72 of receiver 22. Barrel assembly 34 includes trackways 84 (referring to FIG. 6) that correspond to and engage tracks 70. This engagement is configured to allow barrel assembly 34 to slide within receiver 22 between a forward and a rearward position.

As illustrated in FIG. 3, receiver 22 also includes an ammunition feed opening 76, 77 on either side of weapon 20. In the preferred embodiment, an ammunition can 24 (referring to FIG. 1) is mounted, on either side of the weapon, adjacent either ammunition feed opening 76, 77 on receiver 22 to provide ammunition to weapon 20. Ammunition can 24 is positioned external to receiver 22, on either side of the weapon, to allow easy removal and replacement during operation of the weapon.

The ammunition may be fed to the weapon by any means readily apparent to one skilled in the art. In the embodiment illustrated in FIG. 2, an ammunition feed sprocket 54 is provided within receiver 22 to advance the ammunition through the weapon. Feed sprocket 54 moves the ammunition from ammunition can 24 to a strip position adjacent and above the barrel assembly 34.

Figure 3A:
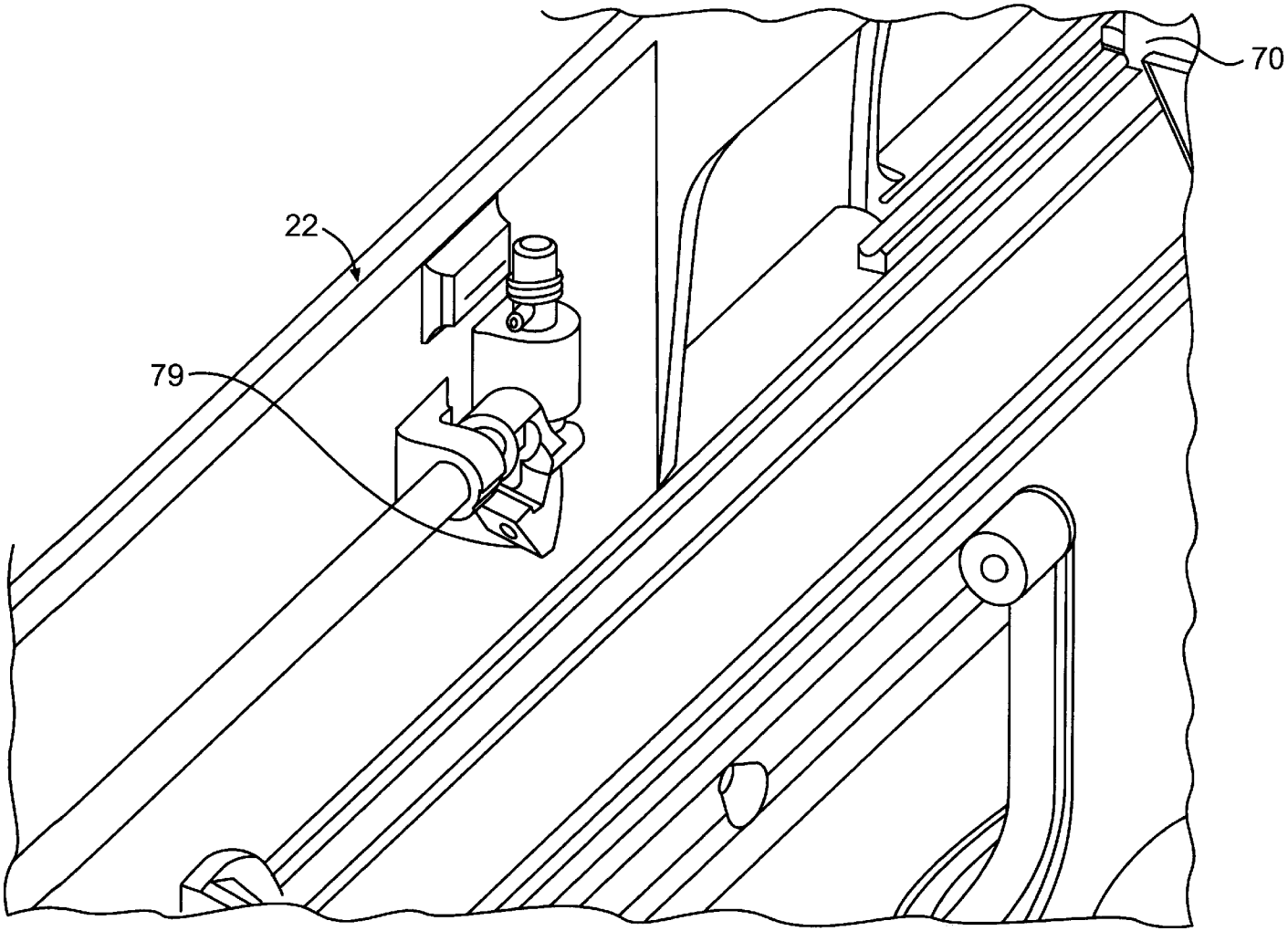
FIG. 3*a* is a partial perspective view of the receiver of FIG. 3, illustrating a cocking lever trip.

As illustrated in FIG. 3*a*, receiver 22 also includes a cocking lever trip 79. Cocking lever trip 79 is located in a fixed position toward the front end of receiver 22 along tracks 70.

Figure 4:
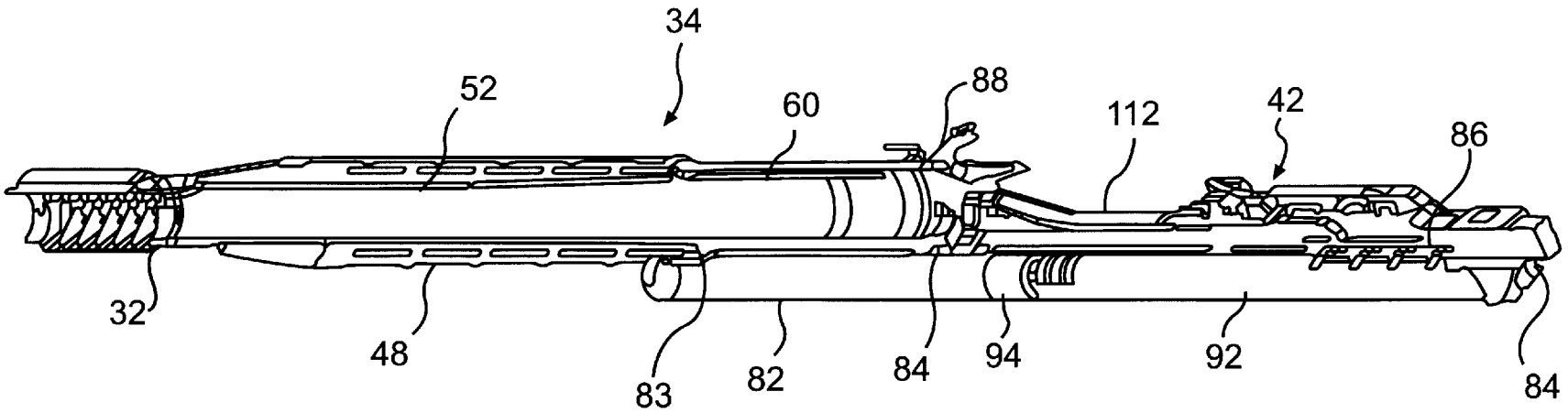
FIG. 4 is a perspective cut-away view of a barrel assembly according to the present invention.

As illustrated in FIG. 4, barrel assembly 34 includes a barrel 52, a barrel extension 60 and a bolt assembly 42. Barrel 52 includes a chamber 88 and breech locking lugs 89. Barrel extension 60 extends rearward from barrel 52 and defines a track 112. Bolt assembly 42 is slidably positioned in track 112. Preferably, the sliding motion of bolt assembly 42 is limited on the forward end by chamber 88 and on the rearward end by a bolt bumper 86.

Figure 5:
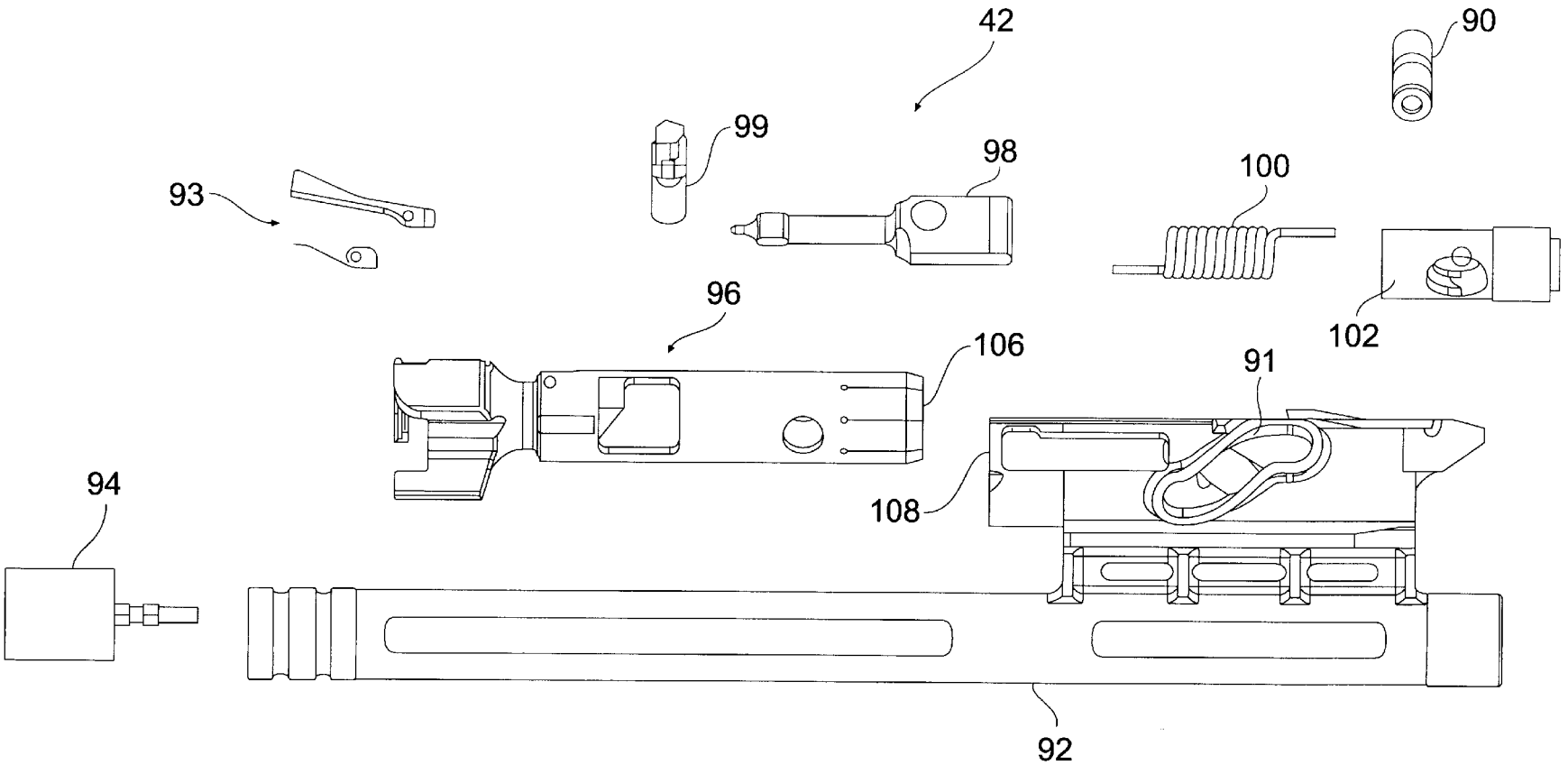
FIG. 5 is an exploded view of a bolt assembly of the automatic projectile firing weapon of the present invention.

As illustrated in FIG. 5, bolt assembly 42 includes a bolt carriage 92, a gas shutoff valve 94, a bolt body 96, and a bolt spring (not shown) disposed within bolt carriage 92. As illustrated in FIG. 4, bolt carriage 92 is slidably disposed within a gas cylinder 82 of barrel assembly 34. In this embodiment, the gas cylinder 82 is an integral part of barrel extension 60. The bolt spring acts on bolt carriage 92 to move bolt carriage 92 forwardly within track 112 and gas cylinder 82 of barrel extension 60. Bolt assembly is engageable with a bolt sear (not shown) to hold the bolt assembly rearward and hold the bolt spring in a compressed condition.

Referring again to FIG. 5, bolt carriage 92 includes an opening 108 to receive bolt body 96 that includes a spring operated rammer 93. Rammer 93 strips a round of ammunition from the ammunition feed belt and feed sprocket 54 as operating spring 44 (referring to FIG. 2) urges barrel assembly 34 forwardly within barrel extension 60. The bolt spring urges bolt assembly 42 forwardly until the stripped round is rammed and locked into chamber 88.

The bolt 96 is stopped when the round is chambered. The bolt carriage 92, however, will continue forward, urged by the bolt spring. Bolt assembly 42 includes a cam pin 90 that engages bolt body 96 and a cam surface 91 in bolt carriage 92. As bolt carriage 92 moves forward, cam pin 90 rides along cam surface 91 to convert the linear motion of bolt carriage 92 into a rotary motion of bolt body 96, to engage the bolt body lugs with barrel lugs 89 (referring to FIG. 4). A carriage buffer 102 removes any excess energy of the bolt carriage.

As shown in FIG. 5, bolt body 96 includes an internal opening 106, which houses a firing pin 98, a firing spring 100, and a spring seat/carriage buffer 102. The final portion of bolt ram is utilized to charge firing spring 100 into cocked position. Firing spring 100 is released when cocking lever 99 contacts cocking lever trip 79 (referring to FIG. 3*a*) mounted in the receiver 22. Firing spring 100 urges firing pin 98 into contact with the round. The force of the contact between firing pin 98 and the percussion primer causes the cartridge to fire. Propellant gas from the fired round is directed into gas cylinder 82 through gas port 83 (referring to FIG. 4). The propellant gas contacts the gas piston of carriage and gas shutoff valve 94 and causes bolt assembly 42 to move rearwardly in track 112.

Preferably, a muzzle device 32 is affixed to the muzzle end of barrel 52. Muzzle device 32 may house muzzle velocity correction components. Muzzle device 32 also operates to shield muzzle gas, hide muzzle flash, and act as a muzzle brake, which reduces net impulse delivered to the weapon.

In accordance with the present invention, a manual retracting device is provided. The retracting device is configured to engage the barrel assembly, prior to firing, to move the bolt assembly rearwardly into engagement with the bolt sear and to move the barrel assembly rearwardly within the receiver and into engagement with the main sear. In the exemplary embodiment, the retracting device includes a pawl that is engageable with the bolt assembly to retract the barrel assembly. It is contemplated that alternative devices for retracting the barrel assembly will be readily apparent to one skilled in the art.

Figure 6:
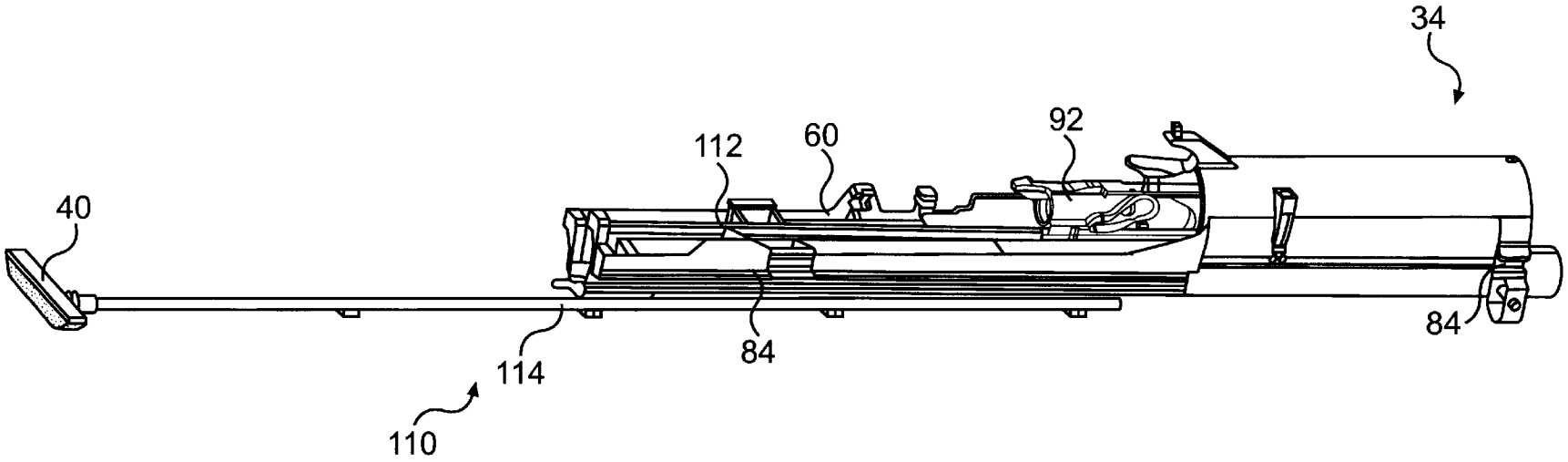
FIG. 6 is a perspective view of a retracting device and a rear portion of the barrel assembly and the bolt carriage according to the present invention.

As illustrated in FIG. 6, a manual retracting device 110 is positioned alongside the rear portion of barrel assembly 34. Retracting device 110 includes a handle 40 and a guide tube 114. Handle 40 is connected to a cable 116 that is disposed in guide tube 114 (referring to FIG. 7).

Figure 7:
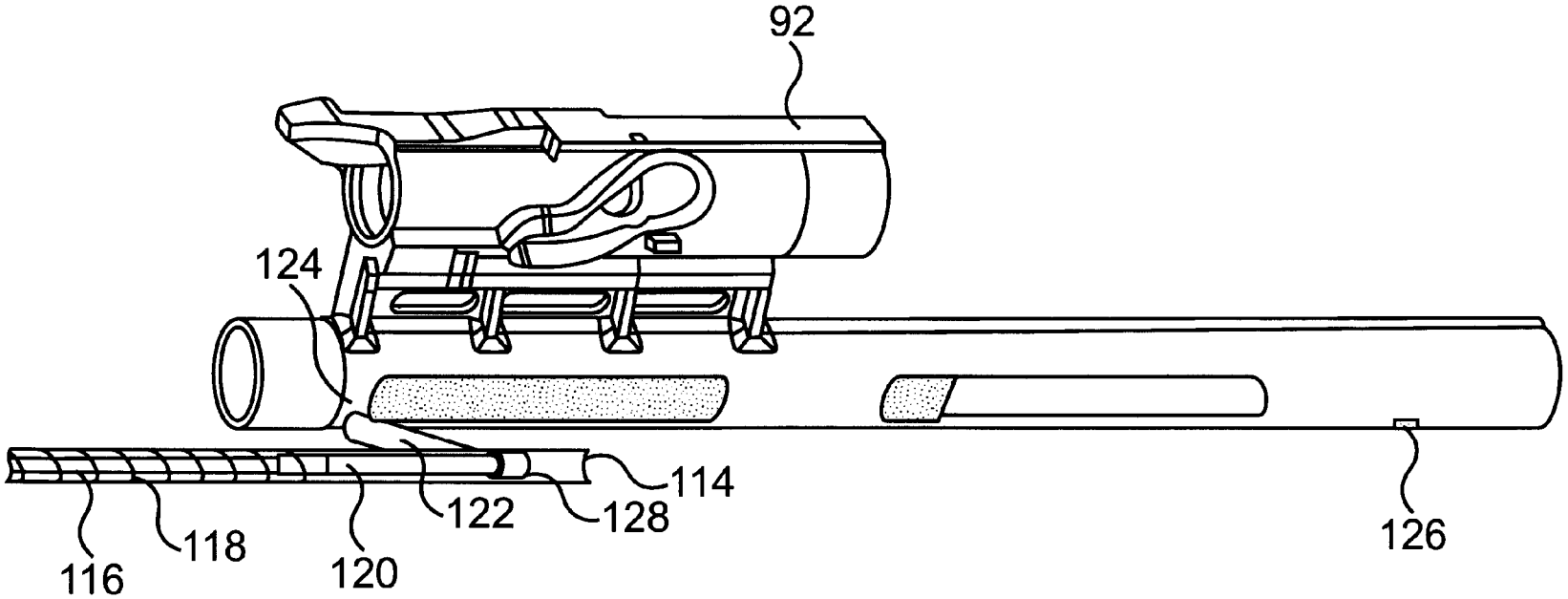
FIG. 7 is a perspective view of the retracting device and bolt carriage of FIG. 6.

As shown in FIG. 7, a pawl 122 and pawl carriage 120 are connected to the end of cable 116 opposite handle 40. A return spring 118 is disposed around cable 116 between handle 40 and pawl carriage 120. Pawl 122 pivots about a pin 128 in pawl carriage 120. Pawl 122 is spring loaded out and configured to engage a slot 124 in bolt carriage 92.

If the weapon is uncharged and handle 40 is pulled from its stowed position, pawl 122 engages slot 124 and moves bolt carriage 92 rearwardly along track 112 in barrel extension 60. Bolt carriage 92 moves rearwardly, compressing the bolt spring until bolt assembly 42 engages bolt bumper 56 and the bolt sear (not shown). The continuing rearward motion of handle 40 and pawl 122 then causes the entire barrel assembly 34 to move rearwardly within receiver 22. The rearward motion of barrel assembly 34 compresses operating spring 44 and continues until barrel assembly 34 engages main sear In the exemplary embodiment, bolt carriage has a second slot 126. In this embodiment, the handle must be retracted twice (equivalent to two half strokes) to move the barrel assembly into engagement with the main sear. When handle 40 is released after the first half stroke, which locks the bolt assembly 42 with the bolt sear, the return spring 118 of the retracting device 110 urges pawl carriage 120 forwardly within guide tube 114. Spring loaded pawl 122 pivots inwardly and rides along the surface of bolt carriage 92 until pawl 122 reaches second slot 126. Handle 40 is then retracted a second half stroke to engage barrel assembly 34 with main sear 130.

Figure 8:
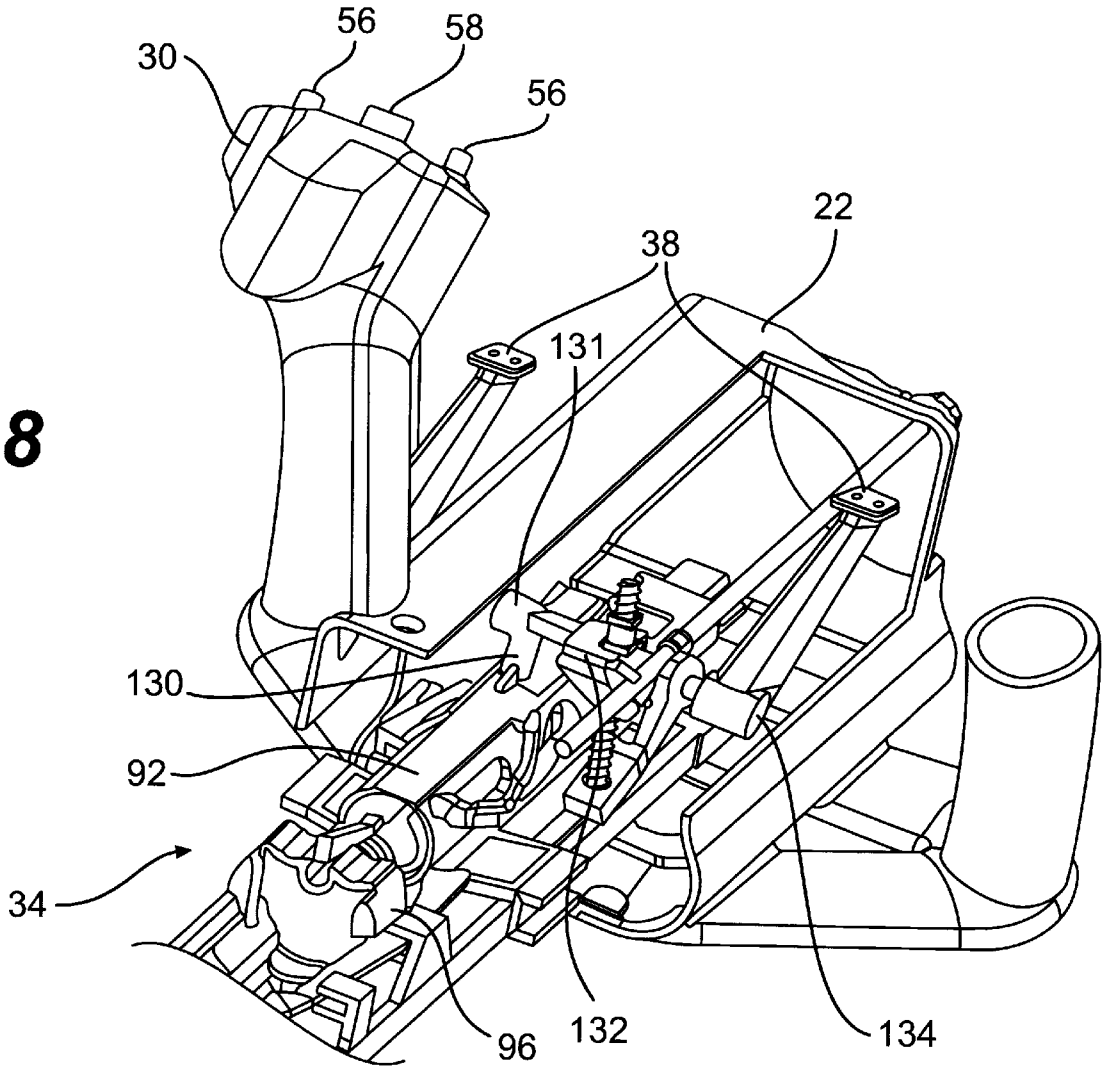
FIG. 8 is a perspective cut-away view of the rear portion of the weapon of the present invention, illustrating the engagement of the barrel assembly with the main sear.

As illustrated in FIG. 8, barrel assembly 34 includes a sear lug 131 on the carriage that engages main sear 130 at the fully rearward position. Main sear 130 is mounted on a trigger shaft 134 within the back cover portion of receiver 22. Triggers 38 are connected to trigger shaft 134. Depressing either or both of triggers 38 causes trigger shaft 134 to rotate. The rotation of trigger shaft 134 disengages main sear 130 from barrel assembly 34 and allows operating spring 44 to move the barrel assembly forward and initiate the firing sequence.

Preferably, receiver 22 also includes a semi-automatic sear 132. Semi-automatic sear 132 is also engageable with barrel assembly 34. Semi-automatic sear 132 may also be mounted on trigger shaft 134 such that if the selector is in the semi-automatic mode, a depression of either or both triggers 38 will cause semi-automatic sear 132 to maintain engagement with barrel assembly 34 after the first shot. When the weapon is operating in semi-automatic mode, semi-automatic sear 132 will engage barrel assembly 34 after each round is fired, even when the trigger is depressed.

In accordance with the present invention, a buffer is connected between the receiver and the barrel assembly. The buffer dampens the movement of the barrel assembly to prevent the barrel assembly from exceeding a predetermined maximum velocity when a round is fired. During the initial portion of the recoil stroke, the buffer maintains a nearly constant force, the magnitude of which is governed by the initial recoil velocity of the barrel assembly, through the rearward travel of the barrel assembly, thereby mitigating the recoil load. The disclosed buffer utilizes a damping fluid and shuttle valves to govern the motion of the barrel assembly, although it is contemplated that other alternatives will be readily apparent to one skilled in the art.

Figure 9:
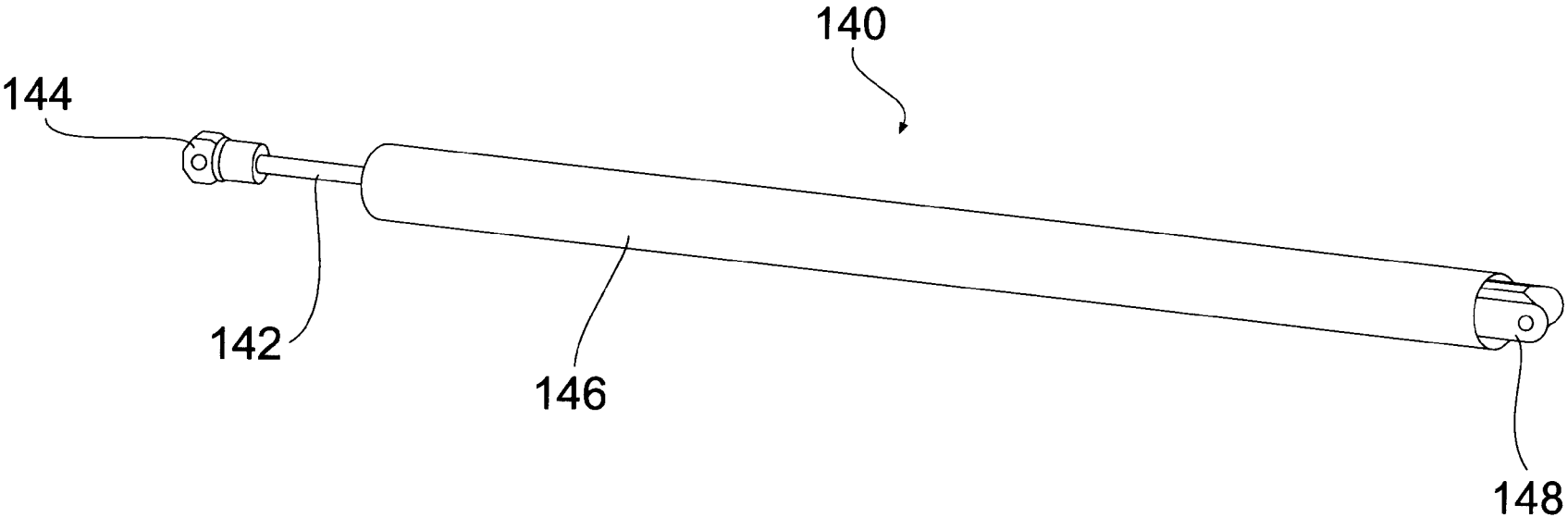
FIG. 9 is a perspective view of a buffer according to the present invention.

As illustrated in FIG. 9, a buffer 140 is provided having a housing 146 and a piston rod 142. A first connecting device 144 is positioned on one end of piston rod 142 and a second connecting device 148 is positioned on one end of housing 146. Buffer 140 is positioned within a buffer compartment 74 of receiver 22 (referring to FIG. 3). Connecting device 144 connects piston rod 142 to barrel assembly 34. Connecting device 148 connects housing 146 to receiver 22. Movement of barrel assembly 34 relative to receiver 22 results in a corresponding movement of piston rod 142 relative to housing 146.

Figure 10:
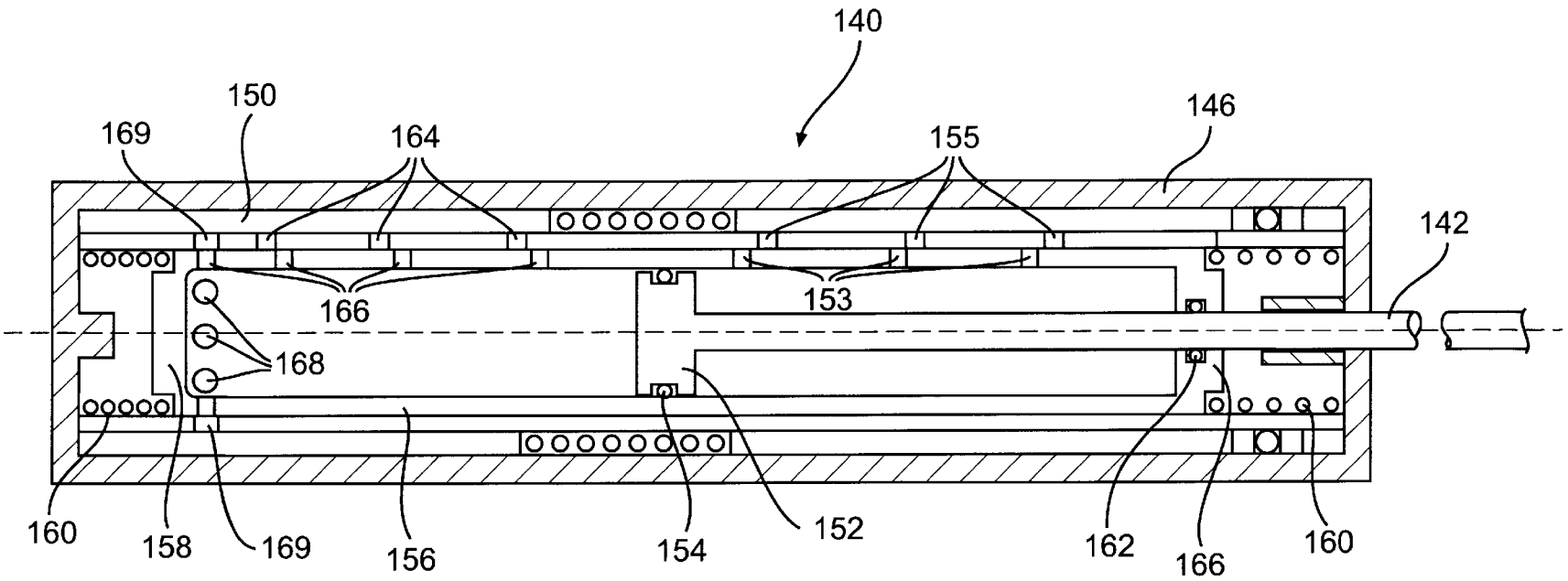
FIG. 10 is a cross-sectional view of the buffer of FIG. 9.

As shown in FIG. 10, buffer 140 includes a reserve 150 of damping fluid, a stationary sleeve 156, and a moving sleeve 158. Stationary sleeve 156 is fixed within housing 146 and moving sleeve 158 is slidably disposed within stationary sleeve 156. A valve spring 160 is positioned on each side of moving sleeve 158 to center moving sleeve 158 within housing 146.

A piston 152 is connected to piston rod 142 and is slidably disposed within moving sleeve 158. Preferably, a seal 154 is disposed around piston 152 to prevent damping fluid from flowing between piston 152 and moving sleeve 158. In addition, a seal 162 is positioned at opening 166 in moving sleeve 158 through which piston rod 142 passes.

The stationary sleeve 156 includes a plurality of buffering orifices 164. The moving sleeve 158 includes a corresponding plurality of buffering orifices 166 and a plurality of larger valve orifices 166. The buffering orifices 166 on moving sleeve 158 are offset from the buffering orifices 164 on stationary sleeve 156.

When piston 152 slides within moving sleeve 158 in response to a corresponding movement of barrel assembly 34, piston 152 forces fluid through valve orifices 168 and 169 and into reserve 150. Valve orifices 168 are large enough that there is little resistance to the movement of piston 152 when the piston is moving at a low velocity. However, as the velocity of piston 152 increases and the rate of flow of fluid through valve orifices 168 increases, the resistance encountered by piston 152 also increases. The increased resistance encountered by piston 152 is opposed by the force of valve spring 160 acting on moving sleeve 158. When the piston reaches a certain velocity, the force exerted by piston 152 on moving sleeve 158 overcomes the force of valve spring 160 and causes moving sleeve 158 to slide within stationary sleeve 156.

The movement of the moving sleeve 158 within the stationary sleeve 156 moves the valve orifices 168 and 169 out of alignment and causes buffering orifices 164 and 166 to align. Because buffering orifices 164 and 166 are smaller than valve orifices 168 and 169, moving piston 152 encounters a greater resistance in forcing fluid through buffering orifices 164 into reserve 150. This increased resistance on piston 152 causes a decrease in piston 152 velocity. As the velocity of piston 152 decreases so does the force exerted on moving sleeve 158. When the velocity of piston 152 decreases below a certain velocity, the force of valve spring 160 moves moving sleeve 158 within stationary sleeve 156 to re-align valve orifices 164 and 166. In this manner, buffer 140 operates to prevent the velocity of piston 152 and connected barrel assembly 34 from exceeding a predetermined maximum velocity.

Preferably, moving sleeve 158 and stationary sleeve 156 have a second set of buffering orifices 153 and 155, respectively. The second set of buffering orifices are positioned such that the velocity of movement of piston 152 in the opposite direction may also be prevented from exceeding a predetermined maximum velocity. In this manner, buffer 140 can govern the velocity of movement of barrel assembly 34 in both directions.

The operation of the aforementioned device will now be described with reference to the attached drawings.

Figure 11:
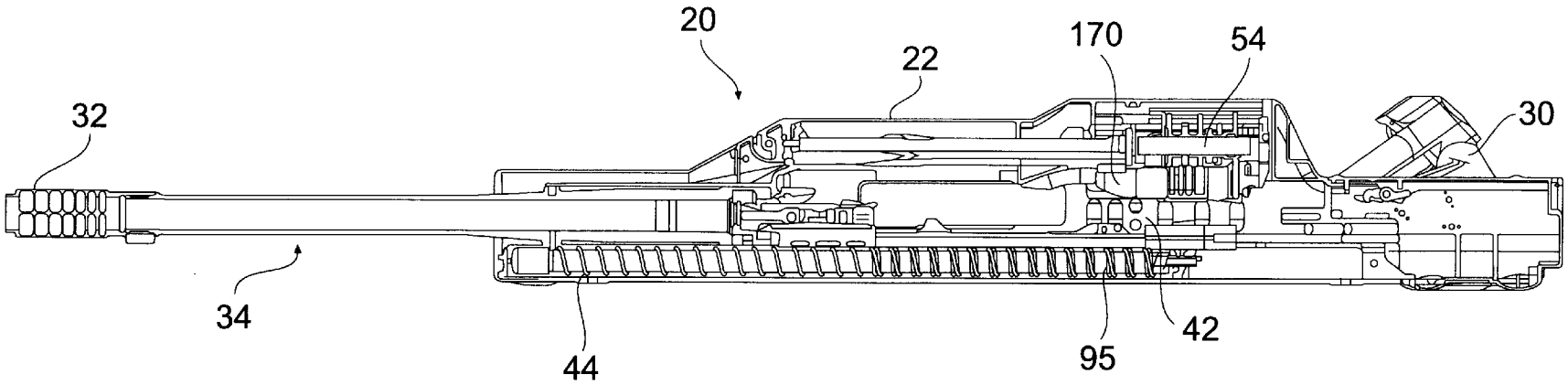
FIG. 11 is a side cross-sectional view of the weapon of the present invention, illustrating the pre-charged state where the operating spring and bolt springs are expanded.

The operation of the automatic projectile weapon of the present invention begins with weapon 20 in the un-charged position as illustrated in FIG. 11. The barrel assembly 34 is in the forward position. The operating spring 44 and bolt spring 95 are at their extended lengths and minimum preloads. The bolt assembly 42 is in its forward and locked position within the barrel extension 60. The ready round 170 (the next round to be fired) is within the ammunition feed sprocket 54.

Figure 12:
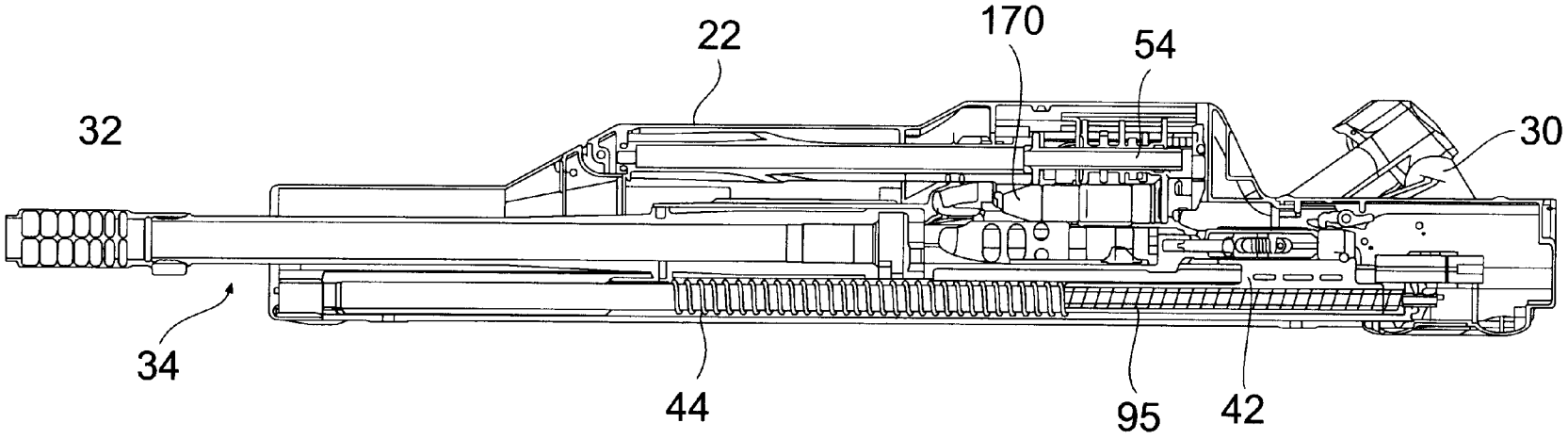
FIG. 12 is a side cross-sectional view of the weapon of the present invention, illustrating the charged state where the operating spring and bolt spring are compressed.

The handle 40 of retracting device 110 is then pulled to charge weapon 20. As illustrated in FIG. 12, the charging stroke compresses bolt spring 95 and operating spring 44. In an alternative embodiment, handle 40 is pulled twice to fully compress the bolt spring and operating spring 44 in sequence.

In the charged position, bolt assembly 42 is latched rearward within the barrel extension 60 by the bolt sear and the barrel extension 60 is latched rearward within receiver 22 by the main sear 130 (referring to FIG. 8). Feeder sprocket 54 advances ready round 170 into the strip position in front of bolt assembly 42. As result of the aftward motion of the barrel extension, the feed sprocket advances one pocket position. Specifically, the cam follower on top of the barrel extension, via engagement with the feed cam, causes approximately 60° rotation of the 6 tooth sprocket with a 6" stroke of barrel extension. The feed cam drives the feed sprocket via a cam pawl. The feed sprocket is retained in the indexed position with a sprocket pawl. Upon forward stroke of the barrel extension (at the beginning of the firing cycle), the feed cam rotates back 600, which moves the cam pawl back one pocket or position. The weapon is now ready to fire.

An optional procedure for preparation of the weapon for firing is to charge the weapon as described above, but without ammunition or unloaded. With the weapon charged, the ammunition belt is introduced into the feed port and the sprocket is manually indexed to position the first cartridge at the belt strip position. This is accomplished simply by overriding the sprocket pawl.

Depressing trigger 38 releases the entire barrel assembly 34 from main sear 130, thereby allowing operating spring 44 to move barrel assembly 34 forward within the receiver 22. As barrel assembly 34 moves forward in receiver 22, bolt assembly 42, via the spring loaded rammer, strips ready round 170 from feed sprocket 54.

Figure 13:
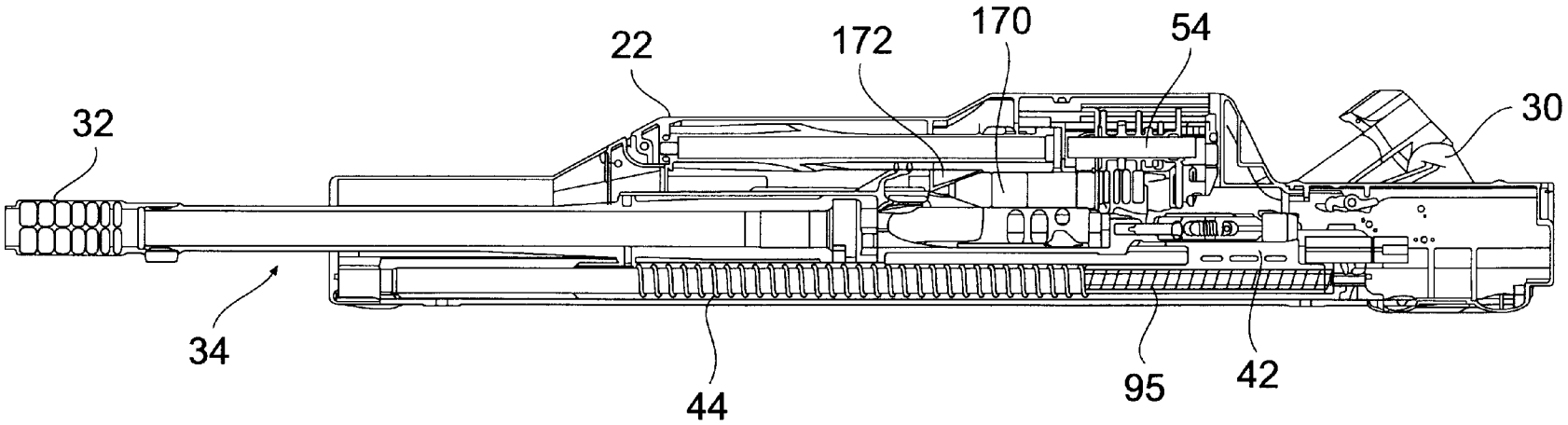
FIG. 13 is a side cross-sectional view of the weapon of the present invention, illustrating the expansion of the operating spring and a round being stripped and rammed.

Following the ammunition strip, the bolt sear releases bolt carriage 92, allowing the bolt spring to move bolt carriage 92 forwardly within barrel assembly 34, while the barrel assembly continues to move forward relative to receiver 22. As illustrated in FIG. 13, a fixed guide 172 within receiver 22 directs ready round 170 toward the centerline of barrel 52. Round 170 is further guided into chamber 88 by fixed guides within the barrel extension 60.

Figure 14:
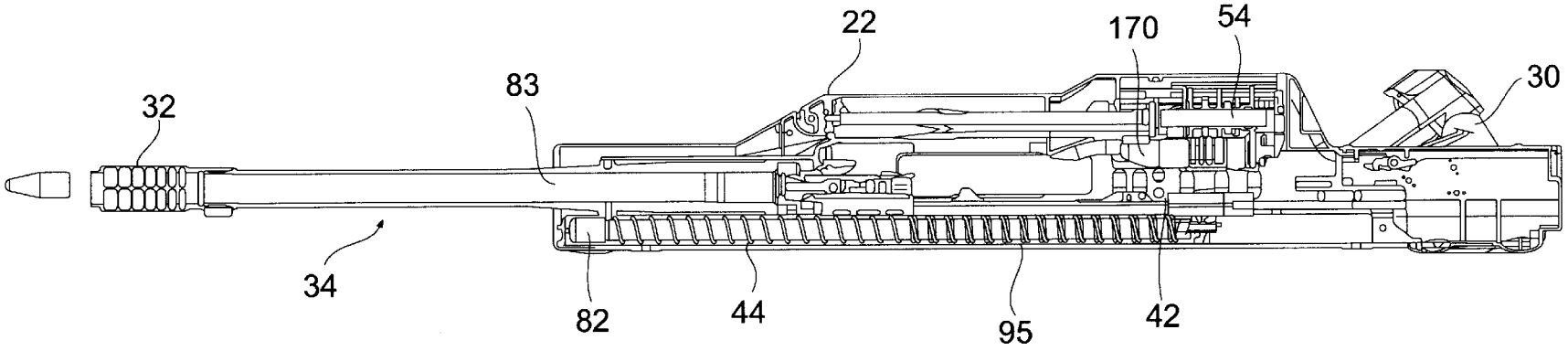
FIG. 14 is a side cross-sectional view of the weapon of the present invention, illustrating the firing position.

As illustrated in FIG. 14, the full expansion of the bolt spring causes bolt assembly 42 to lock round 170 in chamber 88. This is accomplished by the final portion of the longitudinal stroke of the carriage causing rotation of the bolt behind the chambered cartridge. The bolt is interconnected to the carriage via a lock pin 90 (referring to FIG. 5) through the bolt which engages lock cam way 91 of the carriage. The lock rotation (of approximately 54° in this embodiment) is driven by the carriage longitudinal stroke (of approximately 0.85") The forward velocity of barrel assembly 34 is governed by buffer 140 to ensure the barrel assembly does not exceed a predetermined maximum velocity. Upon reaching a fixed position in receiver 22, firing pin spring 100 is released to urge firing pin 98 into contact with round 170. The contact results in round 170 being fired.

Figure 15:
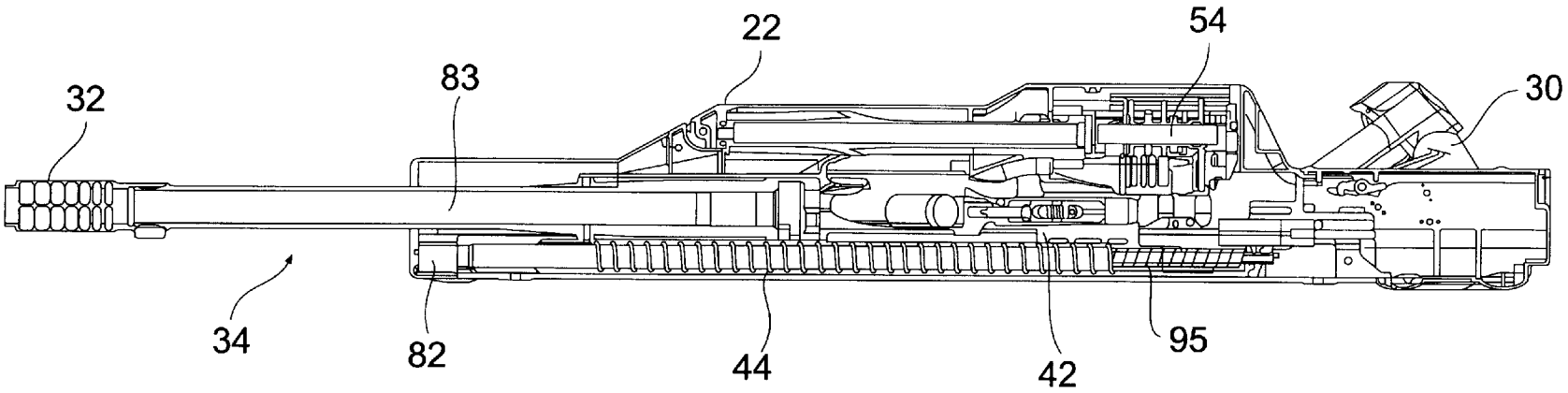
FIG. 15 is a side cross-sectional view of the weapon of the present invention, illustrating the mid-recoil position of the barrel assembly.

Propellant gas from the fired round accelerates the projectile through barrel 52. When the accelerating projectile passes a gas port in barrel 52, bleed gas is directed through gas port 83 into gas chamber 82 to move bolt assembly 42 rearwardly in barrel extension 60 accomplishing unlock of the bolt and extraction of the spent casing from the chamber. As illustrated in FIG. 15, the spent casing 174 is ejected from the bolt face as another round 176 is advanced by feed sprocket 54. Bolt assembly 42 moves rearwardly within barrel extension 60 to compress the bolt spring and re-engage the bolt sear.

Part of the recoil impulse of the fired round cancels the forward momentum of the barrel assembly 34. After this deceleration, the remainder of the recoil impulse accelerates the barrel assembly 34 rearwardly along the recoil stroke within receiver 22. The maximum forward velocity of barrel assembly 34 allowed by buffer 140 is chosen to ensure that the forward momentum of the barrel assembly is not great enough to cancel the recoil impulse of the round and that the remainder of the recoil impulse is great enough to move barrel assembly 34 to the rearward position. The maximum rearward velocity of barrel assembly 34 allowed by buffer 140 is chosen to accomplish the feed index function, recompress the main spring, and to prevent the barrel assembly from moving too far rearwardly within receiver 22. Thus, if barrel 52 of weapon 20 is angled upwardly such that gravity increases the recoiling force of the barrel assembly, buffer 140 will trim the rearward velocity to prevent the barrel assembly from exceeding the predetermined maximum.

Figure 16:
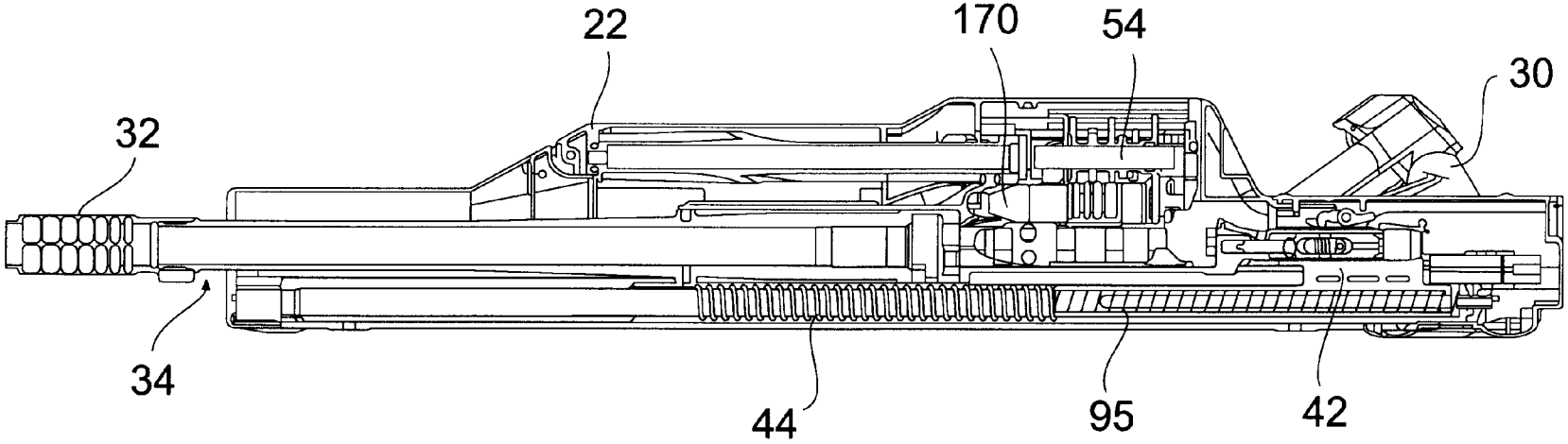
FIG. 16 a side cross-sectional view of the weapon of the present invention, illustrating the maximum recoil position of the barrel assembly.

When barrel assembly 34 reaches the rearward position illustrated in FIG. 16, operating spring 44 is fully compressed. Feeder sprocket 54 has advanced the next round to be fired 176 into the strip position. In the automatic mode, with trigger remaining depressed, operating spring 44 overcomes the rearward momentum of the barrel assembly 34 and the barrel assembly 34 begins to accelerate forwardly within receiver 22 and the firing sequence is repeated. If in the auto mode, and the trigger has been released prior to this point in the cycle, the main sear will engage the barrel assembly to arrest motion and to stop firing.

If the weapon is operating in the semi-automatic firing mode, barrel assembly 34 engages semi-automatic sear 132 at the rearward position. Depression of trigger 38 releases barrel assembly 34 and the firing sequence is repeated.

Thus, the automatic projectile firing weapon of the present invention provides a recoil device that allows the weapon to achieve a steady state dynamic recoil action on the first shot and every shot thereafter. This recoil device minimizes the deleterious effects of conventional gun recoil on light-weight weapon system accuracy. The natural firing rate of the barrel assembly and the gas operation of the bolt further reduce the transmission of recoil forces to the receiver. This reduction of recoil force permits a lightweight weapon and mount configuration, while retaining dynamic stability. The lightweight configuration enhances weapon system capabilities in transport, deployment and field operation.

It will be apparent to those skilled in the art that various modifications and variations can be made in the method of manufacture of the present invention and in construction of this automatic projectile firing weapon without departing from the scope or spirit of the invention. Other embodiments of the invention will be apparent to those skilled in the art from consideration of the specification and practice of the invention disclosed herein. It is intended that the specification be considered as exemplary only, with a true scope and spirit of the invention being indicated by the following claims.

What is claimed is:

1. An automatic projectile firing weapon, the weapon comprising:

a receiver having a main sear and a trackway;

a barrel assembly slidably mounted in said trackway and moveable between a rearward position and a forward position, said barrel assembly being engageable with said main sear at the rearward position and having a firing position between the rearward position and the forward position;

an operating spring connected between said receiver and said barrel assembly, said operating spring biasing said barrel assembly toward the forward position;

a retracting device operable to move said barrel assembly rearwardly into engagement with said main sear, thereby compressing said operating spring;

a trigger for releasing said main sear, thereby allowing said operating spring to move said barrel assembly forwardly; and a buffer connected between said receiver and said barrel assembly to dampen the forward velocity of said barrel assembly such that said barrel assembly is moving at a predetermined maximum velocity when the barrel assembly reaches the firing position, whereby the recoil energy from firing said round is absorbed in part by the forward motion of said barrel assembly and in part by said operating spring.

2. The weapon of claim 1, wherein the receiver further includes a cocking lever trip defining the firing position of the barrel assembly, the cocking lever trip configured to engage the barrel assembly as the barrel assembly moves towards the forward position.

3. The weapon of claim 1, wherein the retracting device comprises:

a pawl engageable with said barrel assembly; and a handle to move said pawl to engage and retract said barrel assembly into engagement with said main sear.

4. The weapon of claim 3, wherein the retracting device further comprises:

a guide tube having a longitudinal slot, said pawl projecting through said slot such that said slot guides movement of said pawl.

5. The weapon of claim 3, wherein said barrel assembly includes a bolt carriage having a slot, said pawl being configured to engage said slot to retract said bolt carriage within the barrel assembly.

6. The weapon of claim 5, wherein said bolt carriage has a second slot, said pawl being engageable with said first slot to retract said bolt carriage within the barrel assembly and engageable with said second slot to retract said barrel assembly into engagement with said main sear.

7. The weapon of claim 1, wherein the buffer includes a housing for containing a damping fluid, a shuttle valve slidably disposed within said housing and having a plurality of orifices, and a piston connected to said receiver and having a head slidably disposed within said shuttle valve, wherein the velocity of movement of said piston head is governed by the rate of movement of the damping fluid through said plurality of orifices between said shuttle valve and said housing.

8. The weapon of claim 1 wherein said buffer is operable to dampen the velocity of said barrel assembly in both the forward and rearward directions.

9. The weapon of claim 2, wherein said barrel assembly includes a barrel having a chamber and locking lugs, a barrel extension, and a bolt assembly slidably mounted in the barrel extension and having a bolt, a bolt carriage, a bolt spring, and a firing mechanism, said bolt spring acting to bias said bolt assembly forward relative to said barrel assembly to load and lock a round into said barrel chamber, said firing mechanism being configured to fire said chambered round when said barrel assembly is moving forward and said barrel assembly reaches said firing location and engages cocking lever trip.

10. The weapon of claim 9, wherein said weapon is disposed to fire a projectile from a cartridge, said bolt assembly including a piston, said piston operating to use gas from a fired round to propel said bolt assembly rearwardly relative to said barrel assembly thereby unlocking said bolt and extracting said cartridge and compressing said bolt spring.

11. The weapon of claim 1, wherein said projectile firing weapon is a lightweight automatic crew served weapon.

12. The weapon of claim 1, including a mount, said mount being connected to said receiver such that said weapon may be positioned on a rigid structure.

13. The weapon of claim 12, wherein said weapon is fixedly positioned on said rigid structure.

14. The weapon of claim 12, wherein said weapon is moveably positioned on said rigid structure.

15. The weapon of claim 12, wherein said mount is connected to said weapon such that said receiver may pivot vertically.

16. The weapon of claim 12, wherein said mount is connected to said weapon such that said gun receiver may pivot horizontally.

17. The weapon of claim 12, wherein said rigid structure is a portable tripod.

18. A method of absorbing the recoil force of an automatic projectile firing weapon having a receiver, a barrel assembly slidably mounted in the receiver, and an operating spring connected between the receiver and the barrel assembly, the method comprising the steps of:

compressing said operating spring by retracting said barrel assembly within said receiver to engage said barrel assembly with a main sear when said operating spring is fully compressed;

initiating a firing cycle by releasing said main sear to allow said operating spring to bias said barrel assembly forwardly within said receiver;

chambering a round to be fired as said barrel assembly moves forward;

buffering the forward motion of said barrel assembly to prevent the barrel assembly from exceeding a predetermined maximum velocity; and firing the round when said barrel assembly reaches a predetermined location in said receiver, the impulse of the fired round reversing the motion of said barrel assembly such that said barrel assembly moves rearwardly to fully compress the operating spring.

19. The method of claim 18, further comprising the step of buffering the rearward motion of said barrel assembly to prevent the barrel assembly from exceeding a predetermined maximum rearward velocity.

20. The method of claim 18, wherein said predetermined location in said receiver is defined by a cocking lever trip.

21. An automatic projectile firing weapon, comprising:

a receiver having a main sear;

a barrel assembly mounted on the receiver for sliding movement between a rearward position where the barrel assembly is engageable with the sear and a forward position, the barrel assembly having a firing position between the rearward position and the forward position;

an operating spring acting on the barrel assembly to bias the barrel assembly into a forward velocity;

a means for disengaging the main sear from the barrel assembly; and a means for buffering the forward velocity of the barrel assembly so that the barrel assembly does not exceed a predetermined velocity when the barrel assembly reaches the firing position.

22. The weapon of claim 21, further comprising a means for retracting the barrel assembly into engagement with the main sear.

23. An automatic projectile firing weapon, the weapon comprising:

a receiver having a main sear;

a barrel assembly mounted in the receiver for reciprocal movement between a rearward position where the barrel assembly is engageable with the main sear and a forward position, the barrel assembly having a firing position between the rearward position and the forward position;

a trigger operable to disengage the barrel assembly and the main sear;

an operating spring acting on the barrel assembly to bias the barrel assembly into a forward velocity; and a buffer operatively connected to the barrel assembly to dampen the forward velocity of the barrel assembly so that the barrel assembly does not exceed a predetermined velocity when the barrel assembly reaches the firing position.

24. The weapon of claim 23, further comprising a retracting device engageable with the barrel assembly and operable to move the barrel assembly to the rearward position and into engagement with the main sear.

25. The weapon of claim 23, wherein the buffer includes a housing, a shuttle valve slidably disposed within the housing and having a plurality of orifices, and a piston connected to the receiver and having a head slidably disposed within the shuttle valve.

26. The weapon of claim 23 wherein the buffer dampens the velocity of the barrel assembly in both the forward and rearward directions.

* * * * *